United States Patent [19]

Bergstein et al.

[11] 3,981,432

[45] Sept. 21, 1976

[54] CARTON WITH TIGHTLY SEALED END CLOSURES

[75] Inventors: Frank D. Bergstein, Cincinnati; Robert W. Nerenberg, Middletown, both of Ohio

[73] Assignee: Bergstein Packaging Trust, Middletown, Ohio

[22] Filed: May 8, 1975

[21] Appl. No.: 575,518

[52] U.S. Cl. ..... 229/37 R; 229/43

[51] Int. Cl.[2] ..... B65D 5/02; B65D 5/64; B65D 43/00

[58] Field of Search ..... 229/37 R, 38, 39, 43

[56] References Cited

UNITED STATES PATENTS

| | | | |
|---|---|---|---|
| 2,187,304 | 1/1940 | Farmer | 229/37 R |
| 2,596,224 | 5/1952 | Eaton et al. | 229/37 R |
| 3,191,847 | 6/1965 | Moore | 229/37 R |
| 3,746,244 | 7/1973 | Bergstein | 229/37 R |

*Primary Examiner*—William Price
*Assistant Examiner*—Douglas B. Farrow
*Attorney, Agent, or Firm*—Melville, Strasser, Foster & Hoffman

[57] ABSTRACT

A tightly sealed carton structure wherein an opposing pair of innermost end closure flaps are hingedly connected to the carton body walls along lines of articulation defining inwardly projecting ridges, the innermost closure flaps each comprising first and second flap parts hingedly connected together with the second flap part reversely folded and adhesively secured to the undersurface of the first part to form a double thickness reinforcing flap, the second flap part being of a length such that its free end edge coincides with the projecting ridge of the line of articulation connecting the flap to the carton body, the free end edge of the second flap part being in wedging engagement with the ridge defining line of articulation when the double thickness flap is infolded at right angles to the carton body wall, thereby providing an essentially rigid planar supporting surface over which the remaining end closure flaps may be folded and tightly sealed; the second flap parts preferably have laterally projecting ears at their free end edges, the ears being bent inwardly and wedged into the corners of the carton to seal against leakage of contents at the corner edges of the juxtaposed and sealed closure flaps; and the closure flaps also may be provided with mating sets of ridges or grooves which interengage when the closure flaps are juxtaposed and sealed, thereby providing barriers between the juxtaposed flaps acting to prevent sifting of the contents of the carton between the flaps.

12 Claims, 10 Drawing Figures

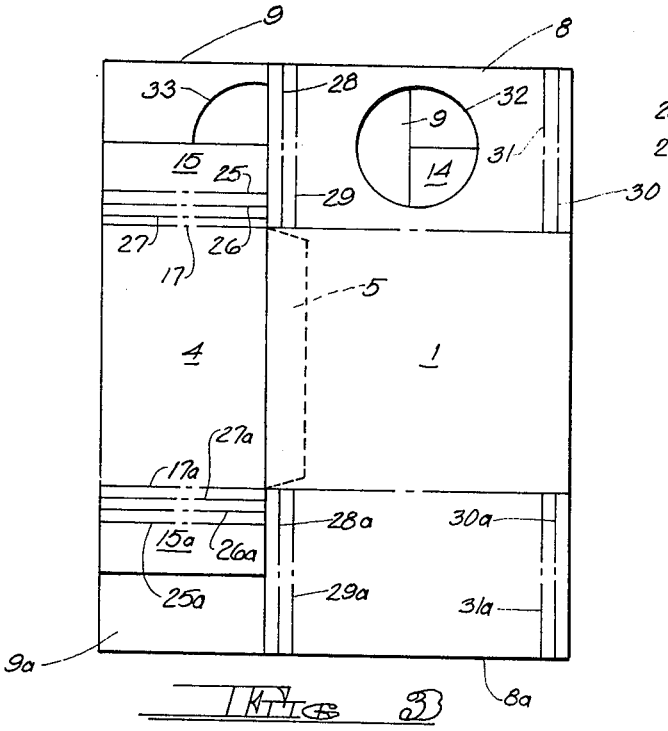
FIG. 3
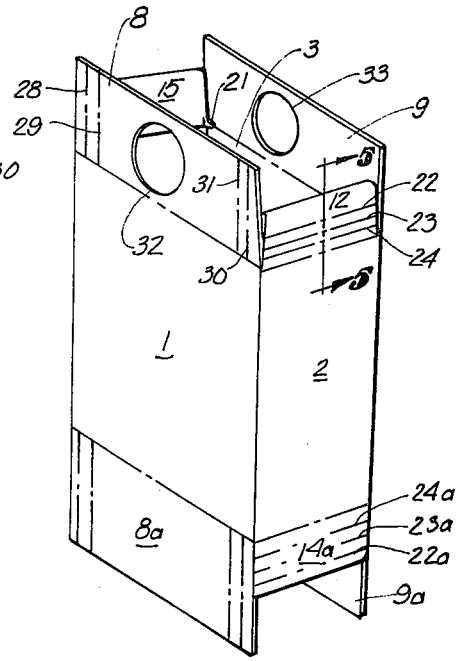
FIG. 4
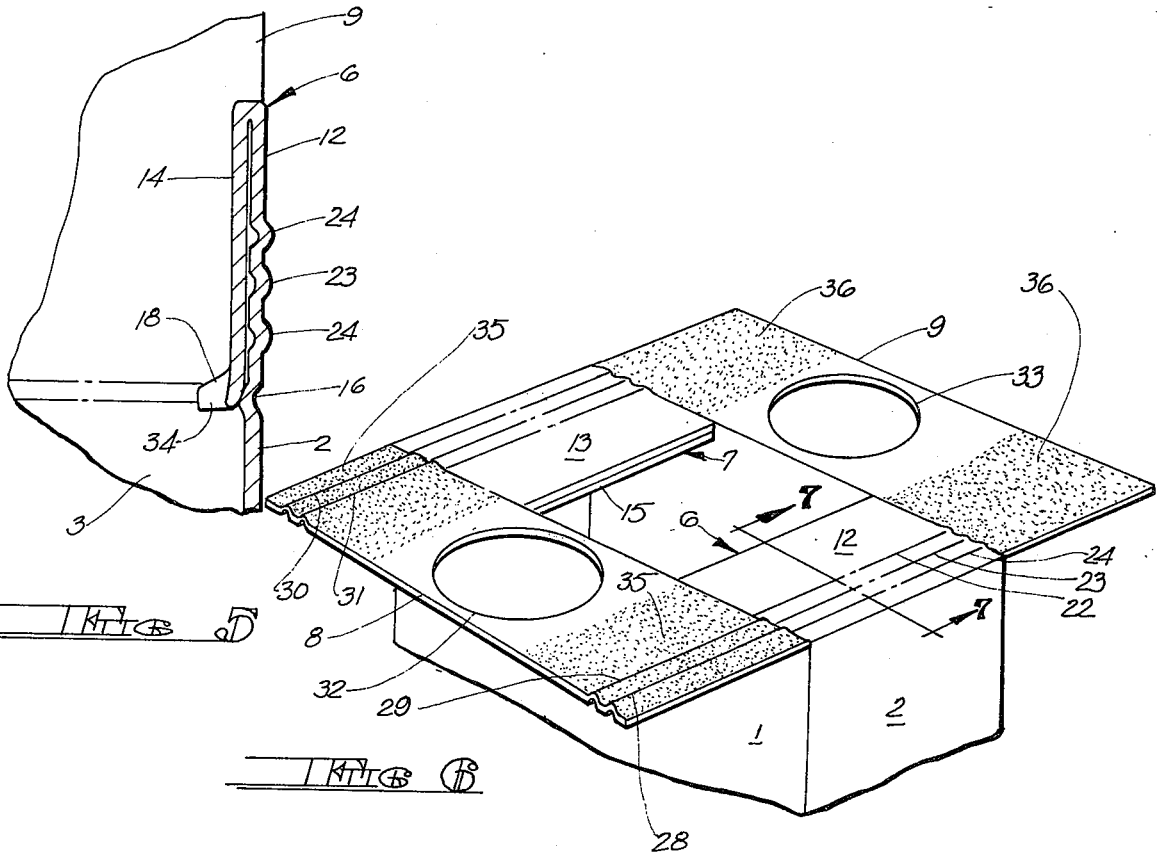
FIG. 5
FIG. 6

CARTON WITH TIGHTLY SEALED END CLOSURES

This invention relates to paperboard cartons and has to do specifically with seal-end cartons in which the enclosing body walls are provided with closure flaps at their ends which are juxtaposed and sealed together to close the carton.

BACKGROUND OF THE INVENTION

The provision of tightly closed and sealed end closure flaps has been a long standing problem in the carton industry, particularly where powdered or granular materials are being packaged. One of the problems is to achieve a tight seal between the juxtaposed closure flaps themselves. In particular, the innermost or first folded pair of flaps are unsupported from inside the carton and hence tend to flex or bend inwardly, resulting in oily partial contact between the folded flaps. Another problem is encountered at the corners of the end closures where so-called "pin-holes" or interstices are formed as the flaps are infolded and sealed, due in part to the fact that the cartons are not truly in square condition when erected, thereby causing the flaps to be out of accurate registry relative to each other.

Numerous constructions have been proposed to provide tightly sealed end closures. From the standpoint of effecting a tight seal between the juxtaposed closure flaps, it has hitherto been proposed to fold the innermost closure flaps upon themselves and provide extensions or tabs on their end edges which are adhesively secured to the inner surfaces of the adjoining carton body walls, thereby providing a truss-like arrangement in which the innermost flaps are prevented from bending inwardly or from twisting, thereby permitting a tight seal to be effected. Such arrangement requires additional boxboard for forming the attachment flaps together with an additional folding and gluing operation. Another approach to the problem is the utilization of interlocking end closure flaps in which the innermost flaps are configured to engage in slots in the next to be folded flap, the interlocking of the several flaps providing support for the sealing pressure applied to secure the flaps together. Such arrangements also insure that the carton body walls will be square and the flaps in accurate registry, thereby further enhancing the tightness of the end closure. While these arrangements provide improved registry and sealing of the flaps, they require extremely accurate infolding of the flaps if proper registry and the interengagement of the flaps is to be achieved, which is difficult to accomplish in a high speed folding and gluing operation.

Numerous expedients have also been proposed to enhance sift-proofness, such as the provision of so-called "VanBuren" ears, which comprise extensions usually connected to the third flap to be infolded, the extensions being folded and adhered to the marginal end edges of the carton body walls. Such extensions, while increasing the sift-proof character of the carton, require additional folding and gluing operations as well as additional boxboard which add to the cost of the cartons.

Another approach to providing a sift-proof end closure is taught in commonly owned U.S. Pat. No. 3,746,244, in the name of one of the present inventors, Frank D. Bergstein, entitled "Sift-Proof Carton Construction," issued July 17, 1973. In accordance with this patent, a plurality of the carton end closure flaps are provided with mating sets of ridges or grooves which interengage when the flaps are juxtaposed and sealed together, the interengaging sets of ridges or grooves providing barriers acting to prevent the sifting and leakage of powdered or granular materials between the closure flaps. The teachings of this patent may be utilized in conjunction with the present invention to further enhance the sift-proof character of the cartons.

SUMMARY OF THE INVENTION

In accordance with the present invention, the lines of articulation hingedly connecting the closure flaps to the carton body walls are formed by scoring rules which contact the outer surface of the blanks for the cartons being formed, the rules acting to indent the paperboard so as to define inwardly projecting ridges. The innermost pair of closure flaps comprise a first or inner flap part and a second or outer flap part hingedly connected to the inner part, the second part being reversely folded and adhesively secured to the undersurface of the first flap part, thereby forming a double thickness flap. The second flap part is slightly longer than the first flap part so that its free end edge will coincide with and overlie the inwardly projecting ridge defined by the line of articulation connecting the first flap part to the adjoining carton body wall. When the innermost flap so-formed is infolded, the free end edge of the second flap part will wedge against the inwardly projecting ridge which exerts pressure against the flap parts tending to urge them upwardly. In net effect, this wedging action, together with the rigidity imparted by the adhesively secured flap parts, constitutes the flap an essentially rigid planar supporting surface against which the outermost closure flaps may be pressed and tightly sealed throughout their full areas of contact. With such arrangement, effectively no additional boxboard is required to form the reinforced flaps, yet sufficient resistance is generated due to the wedging action between the second flap part and the ridge defined by the line of articulation to provide an effective support for the outermost closure flaps during the sealing of the flaps.

In order to insure tight sealing at the corners of the end closures, the second flap parts are provided at their outermost ends with relatively small laterally projecting ears which also coincide with the inwardly projecting ridges defined by the lines of articulation connecting the end closure flaps to the carton body walls. When the carton is tubed and brought to the erected or squared-up condition, these ears will be automatically folded at right angles to the flap parts from which they extend by the end edges of the adjacent carton body walls. Thereafter, when the double thickness innermost end closure flaps are infolded, the ears will be turned through approximately 90° and wedged in the corners of the carton, thus serving to effectively close and seal any "pin-holes" or interstices which may extend through the juxtaposed flaps at the corners of the carton.

To further enhance the sift-proof character of the carton, the aforementioned sets of mating ridges or grooves may be provided in the first or uppermost parts of the innermost flaps, and in the overlying first to be folded of the outermost closure flaps. Preferably the mating sets of ridges or grooves will lie in close proximity to the carton body walls in parallel relation thereto. When the flaps are folded and sealed together, the mating sets of ridges or grooves provide barriers extending the full width of the closure flaps which prevent powdered or granular material from sifting between the flaps.

The invention thus provides for varying degrees of sift-proofness depending upon the requirements of the carton user and the nature of the product being packaged; yet up to the maximum degree of sift-proofness can be achieved at essentially no additional expense insofar as the manufacture of the cartons is concerned. By utilizing the carton construction of the present invention even powdered materials may be packaged without the necessity for a liner or overwrap to insure retention of the contents, and the construction may be readily utilized to provide cannister-type containers wherein the outermost closure flaps are provided with mating dispensing openings adapted to be closed by a removable cover member or cap. Where moisture-vapor proofness is desired, the boxboard from which the cartons are formed may be treated in different ways, including surface layers of wax or other barrier-forming materials, or by the use of laminated boxboard containing one or more integral barrier layers.

DESCRIPTION OF THE DRAWINGS

FIG. 3 is a plan view illustrating the blank of FIG. 2 in knocked-down, flat-folded condition.

FIG. 4 is a perspective view illustrating the blank of FIG. 4 in the squared-up or erected condition.

FIG. 5 is an enlarged fragmentary sectional view taken along the line 5—5 of FIG. 4.

FIG. 6 is a fragmentary perspective view of the erected carton with the innermost closure flaps in infolded condition.

DESCRIPTION OF THE PREFERRED EMBODIMENTS

Figure 1:
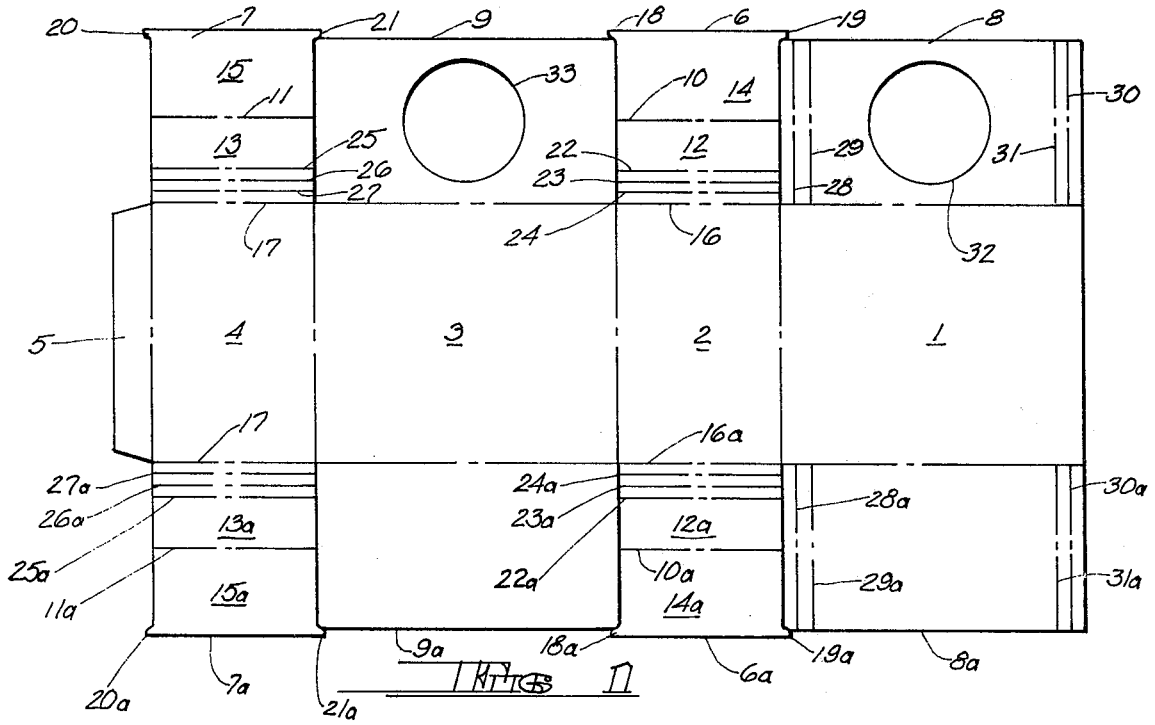
FIG. 1 is a plan view of a carton blank embodying the features of the present invention.

Referring first to FIG. 1 of the drawings, a carton blank embodying the features of the invention comprises a series of body wall panels 1, 2, 3 and 4 in side-by-side articulation, with a longitudinal glue flap 5 extending along the opposite side edge of body wall panel 4. In the embodiment illustrated, the top and bottom end closures are essentially identical comprising sets of innermost or first folded end closure flaps **6, 6*a* and 7, 7*a*, together with sets of outermost closure flaps 8, 8*a* and 9, 9*a*. The latter sets of closure flaps are full-width flaps in that they are each of a width to span the ends of the carton body when erected; and in the embodiment illustrated, the sets of flaps 6, 6*a* and 7, 7*a*** each have a width slightly greater than the width of the outermost closure flaps, the innermost flaps 6 and 7 being divided by lines of articulation 10 and 11, respectively, into first or inner parts 12 and 13, and second or outer parts 14 and 15. Similarly, the innermost flaps **6*a* and 7*a* are divided by lines of articulation 10*a* and 11*a* into inner parts 12*a* and 13*a* and outer parts 14*a* and 15*a*. The width of each of the second parts 14, 14*a* and 15, 15*a* is slightly greater than the width of their corresponding first parts so that, when the second parts are infolded relative to the first parts, the free edges of the first parts will overlie and cover the lines of articulation 16, 17 and 16*a*, 17*a* by means of which the innermost flaps are hingedly connected to the opposite end edges of body wall panels 2 and 4**, respectively.

In accordance with the invention, the scoring rules, which are used to form the lines of articulation 16, 17 and **16*a*, 17*a* are positioned to contact the outer surface of the carton blank, i.e., the surface which defines the outer surfaces of the carton body walls, thereby displacing the boxboard inwardly in the areas contacted by the scoring rules, resulting in the formation of inwardly extending ridges at the end edges of the body walls which effectively form resilient abutments against which the free outer edges of the second parts 14, 14*a* and 15, 15*a*** of the innermost flaps are wedged when the end closure flaps are infolded and sealed.

Sets of ears 18, 19 and 20, 21 project laterally outwardly from the outermost end edges of the second flap parts 14 and 15, respectively; similarly, sets of laterally projecting ears **18*a*, 19*a* and 20*a*, 21*a* project laterally outwardly from the outer flap parts 14*a* and 15*a*, respectively. The sets of ears are relatively small, each having a width substantially equal to the difference in width between the innermost and outermost sets of closure flaps, and their length is preferably the same or slightly greater than their width. As will be evident from FIG. 1, the arrangement is such that in the carton blank the ears lie immediately beyond the corners of the adjoining outermost closure flaps 8, 9 and 8*a*, 9*a*. In over-all configuration, the carton blank utilizes only slightly more boxboard than would be required for a conventional seal-end carton differing only by the added width required for the sets of ears, which is essentially negligible. Even this slight excess of board may be eliminated by making all of the flaps of the same width, with the ears cut from the corners of the adjoining outermost closure flaps in the manner discussed in greater detail hereinafter in connection with FIG. 10**.

Where maximum protection against sifting and possible leakage of contents is desired, the end closure additionally may be provided with mating sets of ridges or grooves of the character taught in the aforementioned U.S. Pat. No. 3,746,244. Thus, the inner flap parts 12 and 13 may be provided with a series of closely spaced apart parallel score lines 22, 23, 24 and 25, 26, 27, respectively, lying in close proximity to the lines of articulation 16 and 17. Mating sets of score lines 28, 29 and 30, 31 are formed in outermost closure flap 8 adjacent its opposite end edges, the sets of score lines in the outermost closure flap 8 coacting with the sets of score lines in the first parts of the innermost flaps when the carton is closed and sealed to form a series of side-by-side barriers effective to prevent the sifting of the contents between the flaps in which the sets of score lines are formed. Corresponding sets of score lines **22*a*, 23*a*, 24*a* and 25*a*, 26*a*. 27*a*** may be formed in first flap parts 12*a* and 13*a*, respectively, at the opposite end of the carton body, with mating sets of score lines 28*a*, 29*a* and 30*a*, 31*a* formed in outermost flap 8*a*. The illustrated sets of coacting barrier forming score lines are representative only; and if barriers are desired, they may take any of the various ridge and groove forming arrangements of score lines set forth in the aforementioned patent.

Where it is desired to form a canister-type carton structure, mating dispensing openings 32 and 33 will be cut in the outermost closure flaps 8 and 9, respectively, the size of the dispensing opening so formed being such that it will lie between the infolded innermost flaps 6 and 7 in the erected and closed carton.

Figure 2:
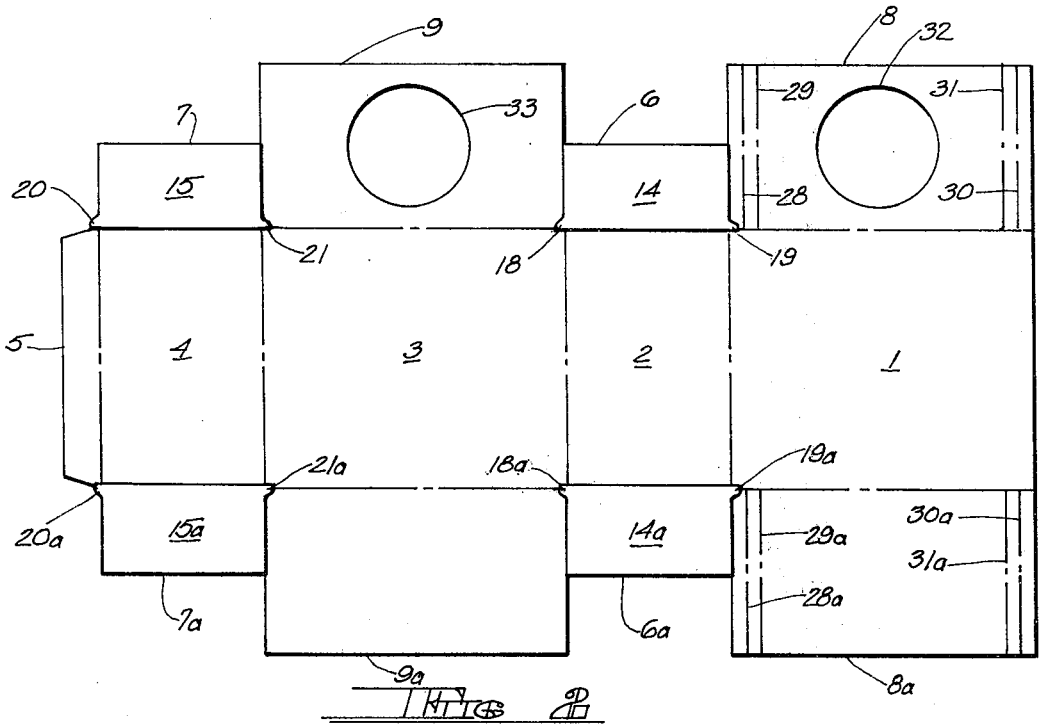
FIG. 2 is a plan view illustrating the blank of FIG. 1 with the second or outer portions of the innermost closure flaps reversely folded and adhesively secured to the underlying first or inner flap parts.

In the fabrication of the carton blank into a carton structure, the second parts 14, 15 and 14*a*, 15*a* of the innermost closure flaps are first infolded to the position illustrated in FIG. 2, with adhesive interposed between the infolded second parts and the underlying first parts, thereby forming double thickness innermost closure flaps. Since the second parts are slightly wider than the first parts, their free side edges will overlie and cover the ridge defining lines of articulation 16, 17 and 16*a*, 17*a*. The folding and gluing of the innermost closure flaps may be readily accomplished utilizing carton folding and gluing equipment. Thereafter, body wall panel 4 is infolded to overlie body wall panel 3, followed by the infolding of body wall panel 1 along its line of articulation to body wall panel 2, thereby bringing the parts to the condition illustrated in FIG. 3, adhesive having been previously applied to either glue flap 5 or the portion of body wall panel 1 which overlies the glue flap, thereby forming a flat-folded tubular carton structure. The glue flap 5 will lie to the inside of body wall panel 1, and hence the ears 20 and 20*a* will lie to the inside of the corners of body wall panel 1 opposite the corners contacted by the ears 19 and 19*a*. It also will be apparent that when the body wall panels 1 and 4 are infolded relative to the body wall panels 2 and 3, respectively, the ears 19, 19*a* and 21, 21*a* will be infolded relative to the second flap parts from which they project by the body wall panels which they overlie. Similarly, when the carton structure is erected or "squared-up" to the condition illustrated in FIG. 4, the body wall panels 2 and 3 will be folded at right angles relative to each other, as will panels 1 and 4, and such folding will result in the infolding of the ears 18, 18*a* and 20, 20*a*. By way of example, and as illustrated in FIG. 5, the ear 18 is folded relative to the second flap part 14 from which it projects by the body wall panel 3, the ear lying along the corner edge of the body wall panel 3, with the bottom edge 34 of the ear lowermost.

As shown in FIG. 6, which illustrates the closing of the upper end of the carton, the carton is closed by first infolding the double thickness innermost closure flaps 6 and 7, followed by the sequential infolding of the outermost flaps 8 and 9. Usually, the outermost flaps 8 and 9 will be initially outfoled for the application of areas of adhesive, indicated at 35, 36, the areas of adhesive 35 being positioned to contact the uppermost first parts 12 and 13 of the underlying innermost flaps 6 and 7, with the areas of adhesive 36 adapted to secure the outermost closure flap 9 to the closure flap 8 which it overlies in the closed structure, external pressure being applied to the closed flaps to seal them together.

Figure 7:
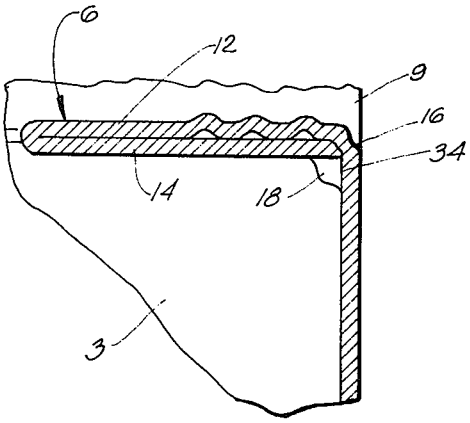
FIG. 7 is an enlarged sectional view taken along the line 7—7 of FIG. 6.

When the double thickness innermost closure flaps 6 and 7 are infolded, the free side edges of the slightly longer second parts 14 and 15 will be wedged against the ridges defined by the lines of articulation 16 and 17, such wedging action, coupled with the resiliency of the ridge defining lines of articulation, acting to urge the innermost flaps upwardly in resistance to their infolding movement. This resistance, coupled with the rigidity imparted to the innermost flaps by reason of their double thickness construction, provides essentially planar supporting surfaces agaisnt which the overlying outermost closure flaps may be pressed and sealed, thereby uniting all of the closure flaps in over-all face-to-face contact. The infolding of the innermost closure flaps also results in the sets of ears being turned through 90°, the folded ears sliding along the corner edges of the body wall panels to which they have been juxtaposed, the ears thereby being wedged into the corners of the carton. This action is illustrated in FIG. 7 wherein it will be seen that the ear 18 has been turned so that its edge 34 is pressed against the corner edge of body wall panel 2, with the ear effectively wedged in the corner of the carton defined by the juncture of the body wall panels 2 and 3 and the infolded double thickness innermost flap 6. It will be understood, of course that the opposite end closure will be closed and sealed in like manner.

It is also preferred that the parts comprising the innermost closure flaps be rectangular, as opposed to having their opposite end edges tapered, so that the opposite end edges of the innermost flaps will lie along and contact the end edges of the adjoining body wall panels. That is, the adjoining flaps are separated from each other simply by lines of cut rather than by cut-out portions which are often employed to separate the adjoining flaps from each other when the carton blank is cut and scored. This construction assists in maintaining the body wall panels in square condition as the carton is closed and sealed and hence provides for accurate registry between the various end closure flaps as they are secured together. In addition, the double thickness end edges of the innermost flaps will contact and to some extent wedge against the inwardly extending ridges defined by the lines of articulation connecting the outermost closure flaps to the ends of the adjoining body wall panels, thereby further enhancing the tightness of the end closure.

Figure 8:
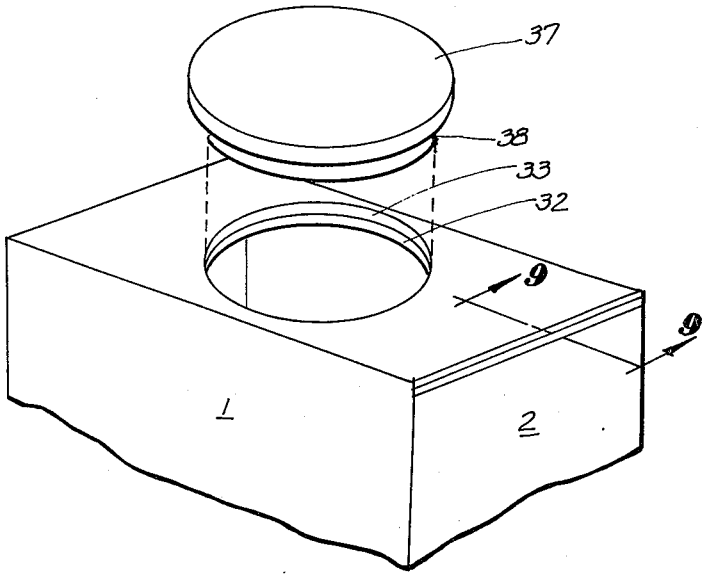
FIG. 8 is a fragmentary perspective view showing the top of the closed and sealed end closure, together with a cap or cover member adapted to close the dispensing opening.

FIG. 8 illustrates the closed and sealed upper end closure, together with a removable cover or cap 37 adapted to be received in the mating dispensing openings 32 and 33. The cap may be formed of metal, a suitable plastic material or other cover-forming material, and preferably it will include a flange or lip 38 adapted to engage the undersurface of flap 8 in the area immediately surrounding opening 32.

Figure 9:
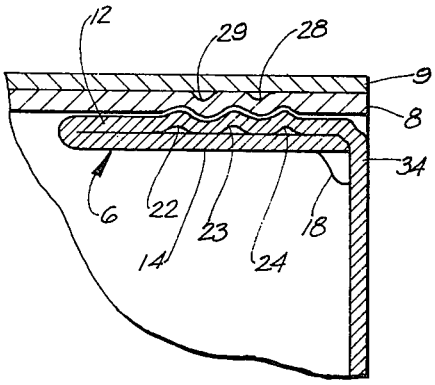
FIG. 9 is an enlarged sectional view taken along the line 9—9 of FIG. 8.

FIG. 9 illustrates the manner in which the sets of barrier-forming score lines coact to enhance the sift-proofness of the carton. As seen therein, the score lines 28 and 29 lie in interdigitating relation with respect to the score lines 22, 23, 24 in the underlying flap part 12, thereby providing a series of barriers which effectively act to prevent contents of the carton from sifting between the innermost flap and overlying outermost flap 8. Thus, the ears effectively plug interstices at the corners of the carton, while the mating sets of score lines define barriers preventing the sifting of contents between the closure flaps themselves, and the rigidified and upwardly biased innermost closure flaps 6 and 7 provide firm supporting surfaces which insure a tight over-all sealing together of the juxtaposed closure flaps.

Figure 10:
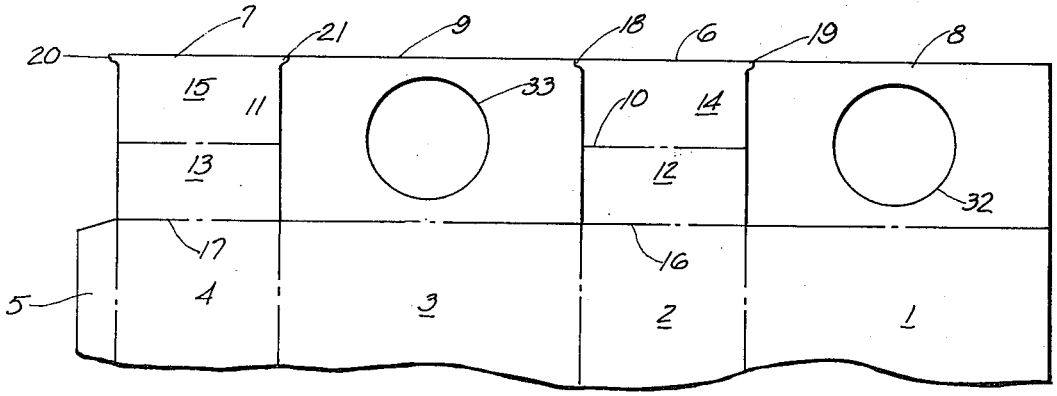
FIG. 10 is a fragmentary plan view of a modified form of carton blank in which the laterally projecting ears are formed from the corners of the adjoining end closure flaps.

Modifications may be made in the invention without departing from its spirit and purpose. For example, as illustrated in FIG. 10, wherein like parts have been identified by like reference numerals, the innermost closure flaps 6 and 7 may be of the same width as the closure flaps 8 and 9, with the ears, such as the ears 18 and 21, struck from the corner edges of the adjoining outermost closure flap 9. In this instance, the lines of articulation 10 and 11 which divide the innermost closure flaps into first and second parts will be positioned so that the second parts 14 and 15 will be slightly wider than the first parts 12 and 13, again by approximately the width of the ears, thereby positioning the outermost edges of the second parts to overlie the lines of articulation 16 and 17 when the second parts are infolded and adhesively secured to the first parts. FIG. 10 will also serve to illustrate that the carton may be formed with or without the barrier-forming sets of ridge or groove defining scores, and also without a dispensing opening and accompanying cover.

The embodiments of the invention in which an exclusive property or privilege is claimed are defined as follows:

1. In a seal-end paperboard carton having enclosing body wall panels defining the carton body and end closure flaps hingedly connected to the end edges of the body wall panels, an improved sift-proof end closure construction comprising an opposing pair of innermost closure flaps and an opposing pair of outermost closure flaps, said pairs of closure flaps being hingedly connected to the carton body wall panels along scored lines of articulation defining inwardly projecting ridges, said innermost closure flaps being divided by scored lines of articulation into first and second parts, with the second parts slightly wider than the first parts so that when the second parts are infolded relative to the first parts the free side edges of the second parts will overlie the ridges defined by the lines of articulation between the first parts and the body wall panels to which they are connected, said second parts being infolded and adhesively secured to the first parts to form double thickness innermost flaps, whereby when said double thickness innermost closure flaps are infolded to overlie the open end of the body, the free side edges of the second flap parts will enter into wedging engagement with said ridge-defining lines of articulation, such wedging engagement acting to urge the said innermost flaps upwardly to provide pressure resistive planar supports over which the outermost flaps may be folded and the flaps tightly secured together throughout their contacting areas.

2. The carton end closure claimed in claim 1 wherein said innermost closure flaps are rectangular, and wherein the opposite end edges of the double thickness innermost flaps, when infolded, lie along and contact the end edges of the body wall panels to which the outermost closure flaps are connected.

3. The carton end closure claimed in claim 1 including ears projecting laterally outwardly from the outermost end edges of the second parts of said innermost closure flaps, said ears being folded and wedged into the corners of the carton when the end closure flaps are infolded and sealed together.

4. The carton end closure claimed in claim 3 wherein some at least of said ears are struck from the outer corner edges of the outermost closure flaps.

5. The carton end closure claimed in claim 4 including mating sets of barrier defining score lines formed in the first parts of said innermost closure flaps and in the first to be folded of said outermost closure flaps.

6. The carton end closure claimed in claim 4 including mating dispensing openings formed in said outermost closure flaps, said openings be positioned to lie between the infolded innermost closure flaps, and a cover member for closing the dispensing opening so-formed.

7. A carton blank for forming a seal-end paperboard carton having sift-proof end closures, said blank comprising a series of four body wall panels in side-by-side articulation, with sets of end closure flaps at the opposite ends of said body wall panels, said sets of end closure flaps each comprising a pair of full-width outermost closure flaps hingedly connected to the end edges of the first and third of said body wall panels, a pair of innermost closure flaps hingedly connected to the end edges of the second and fourth body wall panels, said innermost closure flaps having a width at least as great as said outermost closure flaps, said innermost flaps being divided by lines of articulation into an inner first part and an outer second part, the outer second part being of a width slightly greater than the width of the first part, whereby when said second parts are infolded relative to the first parts, the free side edges of the first parts will overlie the hinge lines connecting the first parts to said second and fourth body wall panels, said last named hinge lines comprising scored lines of articulation defining ridges projecting in the direction of the second flap parts when infolded.

8. The carton blank claimed in claim 7 including pairs of ears projecting laterally outwardly from the free side edges of said second parts, said ears having a width substantially equal to the difference in width between said first and second parts.

9. The carton blank claimed in claim 8 wherein the combined widths of the first and second parts of said innermost closure flaps are equal to the widths of said outermost closure flaps, and wherein some at least of said laterally projecting ears are struck from the outer corner edges of said outermost closure flaps.

10. The carton blank claimed in claim 8 wherein the combined widths of the inner and outer parts of the innermost closure flaps are slightly greater than the widths of said outermost closure flaps, and wherein some at least of said laterally projecting ears lie immediately outwardly beyond the outermost side edges of said outermost closure flaps.

11. The carton blank claimed in claim 10 including a plurality of closely spaced apart ridge defining score lines formed in the first parts of said innermost closure flaps, and mating ridge forming score lines in one of said outermost closure flaps.

12. The carton blank claimed in claim 11 including mating dispensing openings in one of said pairs of outermost closure flaps.

* * * * *